United States Patent [19]

Offermann

[11] Patent Number: 4,713,148

[45] Date of Patent: Dec. 15, 1987

[54] LIGHT CONSTRUCTION PLUG FOR COKE OVEN DOORS

[75] Inventor: Ludwig Offermann, Olfen, Fed. Rep. of Germany

[73] Assignee: Firma Carl Still GmbH & Co. KG, Fed. Rep. of Germany

[21] Appl. No.: 801,151

[22] PCT Filed: Mar. 12, 1985

[86] PCT No.: PCT/EP85/00096

§ 371 Date: Nov. 12, 1985

§ 102(e) Date: Nov. 12, 1985

[87] PCT Pub. No.: WO85/04180

PCT Pub. Date: Sep. 26, 1985

[30] Foreign Application Priority Data

Mar. 14, 1984 [DE] Fed. Rep. of Germany ..... 34092242

[51] Int. Cl.[4] ..... C10B 25/06

[52] U.S. Cl. ..... 202/248; 202/242

[58] Field of Search ..... 202/242, 248; 110/173 R; 49/482, 483

[56] References Cited

U.S. PATENT DOCUMENTS

| | | | |
|---|---|---|---|
| 2,275,400 | 3/1942 | Koppers | 202/248 |
| 2,571,597 | 10/1951 | Millard | 202/248 |
| 2,993,845 | 7/1961 | Coe | 202/248 |
| 3,505,174 | 4/1970 | Peterson et al. | 202/248 |
| 4,200,498 | 4/1980 | Dinello | 202/248 |
| 4,217,177 | 8/1980 | Gerding et al. | 202/248 |
| 4,231,846 | 11/1980 | Mathiak et al. | 202/248 |
| 4,263,101 | 4/1981 | Thiersch et al. | 202/248 |

FOREIGN PATENT DOCUMENTS

| | | |
|---|---|---|
| 58320 | 8/1982 | European Pat. Off. . |
| 1671347 | 9/1971 | Fed. Rep. of Germany . |
| 2945017 | 5/1981 | Fed. Rep. of Germany . |
| 8313165 | 11/1983 | Fed. Rep. of Germany . |

*Primary Examiner*—Barry S. Richman
*Assistant Examiner*—Joye L. Woodard
*Attorney, Agent, or Firm*—McGlew and Tuttle

[57] ABSTRACT

The invention relates to a light construction plug for coke oven doors of horizontal chamber coking ovens, consisting of box-like, heat-resistant, metallic hollow bodies which are secured on the door body and can be filled with insulating material of low specific gravity. According to the invention, it is provided that in the longitudinal direction of the chamber, between the door body (1) and the chamber filling (5), one or more detachably interconnected hollow bodies (6, 7) are arranged and that for the formation of vertical gas pressure equalizing channels (10) between the chamber walls (11) and the hollow bodies (6, 7) the lateral outer walls (8, 9) thereof have concavities directed inwardly toward the center of the chamber.

15 Claims, 1 Drawing Figure

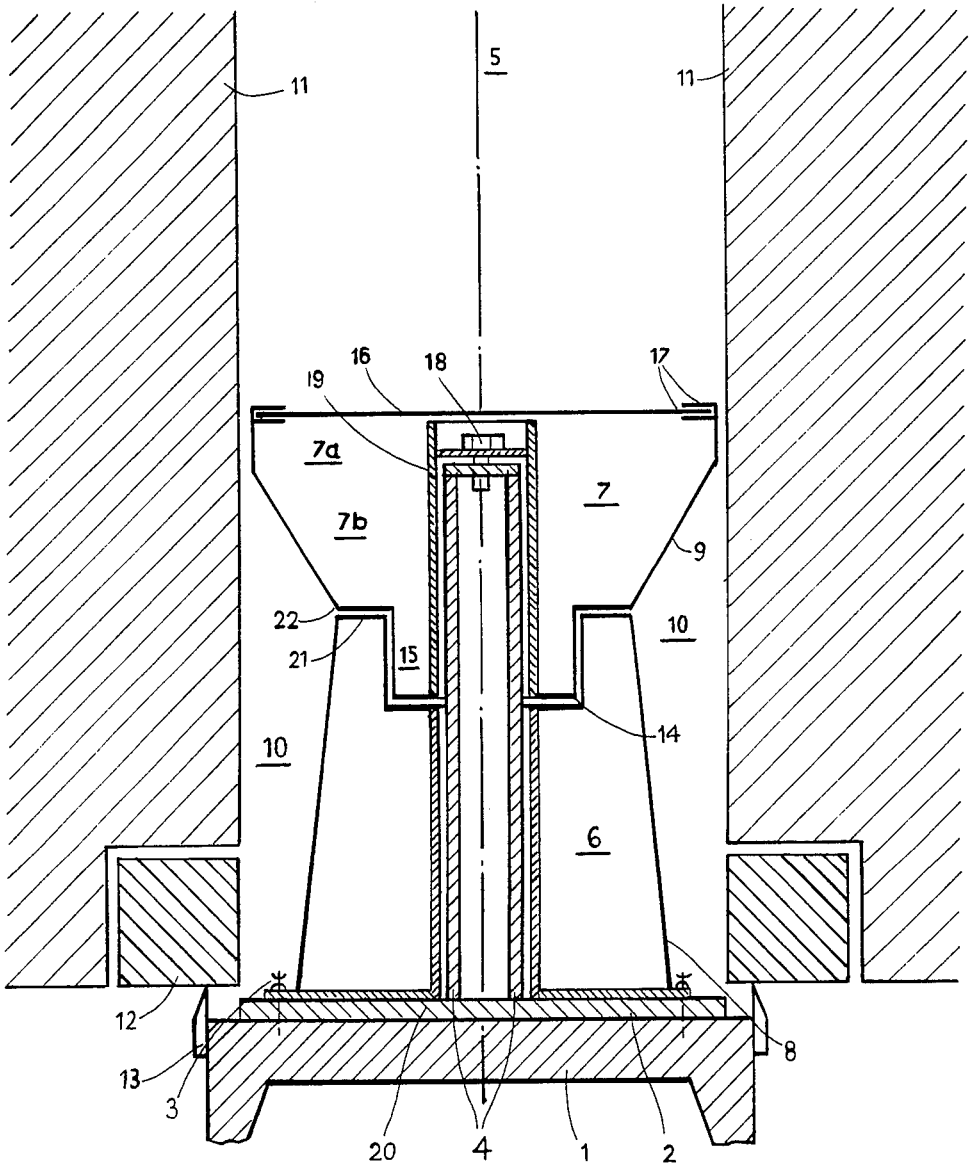
5
11
11
16
18
17
19
7a
7
7b
9
22
10
21
15
14
10
6
12
8
13
3
20
4
1
2

LIGHT CONSTRUCTION PLUG FOR COKE OVEN DOORS

FIELD AND BACKGROUND OF THE INVENTION

The invention relates to a light construction plug for coke oven doors of horizontal chamber coking ovens, consisting of box-like, heat-resistant metallic hollow bodies which are fastened to the door body and can be filled with insulating material of low specific gravity.

In recent times there has been a demand on the part of technology for light coke oven doors. Because of extreme height of the modern coking ovens of up to 8 m, doors of conventional construction are very heavy, and consequently also the operating machines, as for example the coke oven door lifters, become heavier and heavier. An attempt has therefore been made to replace the conventional construction with a heavy plug of refractory brick materials by lighter models. At a reduced weight of the brick plug or door plug, also the construction of the door body itself or respectively of the door frame can be made lighter. It is a technological need to design the coke oven doors in such a way that their weight is substantially reduced.

Coke oven doors are known, for example, where the heavy brick plug is replaced by protective shields, usually of metallic materials. These heat protection shields are secured to the door body by means of spacers and form a vertical gas collection space which communicates with the horizontal gas collection space above the coal cake (German DE-OS No. 29 45 017). In this publication it has been proposed also to let the hollow plug extend less far into the chamber or respectively to reduce the distance between the door body and the heat protection shield in comparison with the thickness of the heavy refractory brick plugs, in order to increase the chamber volume of the coke oven and hence the coke production.

Also, the heavy brick plugs have been provided with vertical channels, so that in the vicinity of the oven door a gas-side pressure equalization between the lower and upper portions of the oven chamber could be established (U.S. Pat. No. 4,217,177). Then, however, there was the danger of these channels becoming clogged in time, because graphite depositions would form on the walls and the graphite coating would gradually grow until an insufficient passage of gas, or none at all, would occur.

German DE-OS No. 16 71 347 discloses the realization and design of a light door plug and a closure device for horizontal coking ovens consisting of a door body with a plug of refractory mineral substances and a covering of a smooth, porefree, highly heat-resistant radiating sheet as well as of a door frame and a seal at the door body and door frame. A door plug covering sheet fills the gap toward the chamber walls and extends the chamber floor. This sheet is bent, forms wings, and is held by struts. On both sides of the plug a vertical gas flue (discharge channel) is formed, which is to serve for gas pressure equalization.

SUMMARY OF THE INVENTION

The object of the invention now is to propose a light door plug of this kind:

which is easy to exchange;

where the lateral gas pressure equalizing channels are easily accessible and easy to clean; and where the size of the gas pressure equalizing channels can be adapted to the particular heating conditions and to the type of coal of the coking chambers.

For the solution of this problem it is proposed that, in the longitudinal direction of the chamber, between the door body and the chamber filling, one or more detachably interconnected hollow bodies are arranged, and that for the formation of vertical gas pressure equalizing channels between the chamber walls and the hollow bodies, the lateral outer walls thereof have concavities directed inwardly toward the center of the chamber. By this new design of the light construction plugs, on the one hand, a sufficient stability is obtainable, and on the other hand, the vertical gas pressure equalizing channels can be made as large as possible, whereby at the same time the weight of the plug is substantially reduced.

To improve the exchangeability and the variability of the thickness of the light construction plug and of the size of the gas pressure equalizing channels, the invention provides that in the longitudinal direction of the door, the light construction plug consists of several hollow bodies arranged at little or no distance from each other. This arrangement of several single hollow bodies permits, in particular, the use of a flexible door body, as described e.g. in German Utility Model No. 79 13 785. These individual hollow bodies arranged over the length of the door can be employed, in particular, in the elastic door body constructions which have become known in recent times (e.g. German Utility Model No. 83 13 165).

The invention provides, in particular, that the individual hollow bodies are closed at the entire circumference and/or above and below and are preferably filled with high-grade insulating material, such as moler granulate or ceramic filling compound. Even if the sheet-metal jacket is thin, such hollow bodies have a high strength, and by the inner high-grade insulating material it is achieved that little heat is transferred out of the coke over chamber or from the crude gas flowing in the gas pressure equalizing channel to the door body.

For the attachment of the hollow bodies to the door body back, the invention provides that the individual hollow bodies have inner channels which can be slipped onto one or more holding devices fastened to the door body and having the same profile as the channels. To vary the thickness of the light construction plug and the size of the gas pressure equalizing channels, the hollow bodies can be fixable on the holding devices at different distances from one another. To this end simple lock screws or wedges are used. It has proven favorable to attach the holding devices to the back of the door body horizontally in the longitudinal direction of the chamber or, for additional safety, slightly ascending toward the free end. One or more holding devices per hollow body may be arranged on the width of the door or also in longitudinal direction of the door. According to the invention, the holding devices may consist of the usual sectional iron, in particular hollow sections with round or rectangular cross-sections. For one channel per hollow section it has proven favorable to dispose the latter in the upper part, so that the physical center of gravity of the hollow sections lies below the suspension. It is thereby achieved that the plug assumes a vertical position.

It may also be provided that at least one of the hollow bodies has a trapezoidal cross-section, the parallel sides of which extend in the longitudinal direction of the battery. If two hollow bodies with trapezoidal cross-section are provided, appropriately the shorter of the parallel sides are correlated with one another. In this manner the two longer bases are turned, on the one hand, toward the door body, and on the other hand toward the coal contacting surface, and approximately in the center between these, two approximately triangular gas pressure equalizing channels are formed by the trapezoidal cross-sections laterally between the chamber walls and the hollow sections. The length of the two long parallel bases of the trapezoidal cross-sections approximately correspond to the width of the conventional plugs.

The coal contacting hollow body may consist, on the coal side firstly, of a narrow rectangular cross-section, which corresponds to the usual width of the plug, and contiguous thereto of a trapezoidal cross-section. This causes a heat protection shield of sufficient thickness to exist on the coal side.

To vary the thickness of the entire light construction plug, it is possible to move the coal contacting hollow body farther out on the holding sections, thus forming a variable distance between the hollow body attached to the door body and the coal contacting hollow body. Thereby also the size of the lateral gas pressure equalizing channels is varied at the same time. The invention provides moreover that between the hollow bodies with trapezoidal cross-section one or more hollow bodies with rectangular cross-section are insertable. Thereby the stability of the plug is increased and an additional heat protection shield is obtained. This is true in particular if these additional inserted hollow bodies extend approximately over the entire width of the chamber. The stability and stiffness of the individual hollow bodies can be further increased by providing at the transition from one to the other, on one side, vertical rectangular cutouts, into which there engages a correspondingly shaped shoulder of the adjacent hollow body. Thereby the hollow bodies can, within certain limits, be displaced relative to each other continuously without a connection existing between the two lateral gas pressure equalizing channels.

The invention further provides that the coal contacting plate of the inner hollow body is held by lateral or upper and lower guide slits and is extractible for exchange. In this manner, a rapid and simple replacement of this coal contacting plate is possible.

BRIEF DESCRIPTION OF THE DRAWINGS

The invention is explained by way of example more specifically with reference to the attached FIGURE, which is a horizontal section through a part of the door body and the light construction plug according to the invention.

DESCRIPTION OF THE PREFERRED EMBODIMENT

On the side of a door body 1 toward the interior of a coke oven chamber 5 a plate 2 is applied on which a hollow body 6 is fastened. The hollow body 6 is divided into several segments over the height of the door, as is also the second hollow body 7. The hollow bodies 6 and 7 consist of heat-resistant outer sheetmetal jackets, which have predominantly trapezoidal in cross-secton and are directed toward each other, so that the longer bases are turned on the one hand toward the door and on the other hand toward the coal. The hollow bodies are self supporting. The hollow body 6 mounted on the door body 1 of respectively on the plate 2 has cutouts 14, and the hollow body 7, has shoulders 15 which engage in the cutouts 14. Instead of the cutouts 14 and shoulders 15, the two hollow bodies may have their smaller, parallel surfaces lying opposite each other without cutout and shoulders. To increase and to reduce the space for the pressure equalization, appropriate intermediate pieces with preferably rectangular cross-section are then inserted between the two hollow bodies 6 and 7. In the illustrated case, the channels 19 and 20 made of square pipes, distributed over the height in the region of the cutouts 14 and shoulders 15 for the passage of the holding sections 4 likewise consisting of square pipes, are illustrated. The hollow bodies 6 and 7 are secured against horizontal displacement through lock screws or wedges 18. The two hollow bodies 6 and 7 are filled in their interiors with high-grade insulating material, e.g. of moler granulate or ceramic filling compound, so that heat from the coke oven chamber and from the crude gases flowing in the gas pressure equalizing channels 10 is transferred to the door body to a minor degree. A coal contacting plate 16 of the hollow body 7 is inserted in lateral, vertical guide slits 17 and can be changed when needed.

The plate 2 is connected to the inside surface of door body 1 by fastening screws 3. Seals 13 are connected to the lateral edges of door body 1 and bear against the door frame 12 which is connected in the chamber walls 11.

It is noted that the coal-contacting plate 16, which contacts coal filling the chamber 5, is carried on a rectangular cross section part *7a* of the hollow body 7. Hollow body 7 also includes a trapezoidal part *7b*, which is connected to the trapezoidal cross-sectioned hollow body 6.

The lateral or outside walls 8 and 9 of the hollow bodies 6 and 7 respectively, define the substantially triangular cross-sectioned gas pressure equalizing channels 10, on each side of the hollow door bodies. Equalizing channels 10 are closed laterally by the chamber walls 11.

End faces 21 and 22 of hollow bodies 6 and 7 respectively, are contoured to mate closely with each other. This is true whether the cut-outs or recesses 14 and shoulders 15 are provided or whether the end faces 21 and 22 are merely plainer and lie opposite each other without recesses or shoulders.

I claim:

1. A coke oven door in combination with a coke oven having a coke oven chamber and spaced apart wall portions defining a chamber opening therebetween; said coke oven door comprising a door body for engaging over the chamber opening to close the opening; at least a first and a second box-like metallic hollow body connected to and supported by said door body and closely engaged with each other, said first hollow body being adjacent to said door body and said second hollow body being spaced away from said door body so that said at least first and second hollow body extend serially into the chamber between the wall portions to form a plug extending inwardly of the chamber with said door body engaged over the chamber opening with the hollow bodies and said door body are in a closed position; said first hollow body including a pair of laterally spaced outside walls and said second hollow body including a pair of laterally spaced outside walls, said outside walls of said first hollow body cooperating with said outside walls of said second hollow body and said chamber spaced apart wall portions to define laterally spaced concave and vertically extending gas pressure equalizing channels; said at least first and second hollow body being detachable from each other and detachably connected to said door body to allow for replacement whereby a horizontal cross-sectional shape of said pressure equalizing channels can be changed.

2. A combination according to claim 1, wherein each of said first and second box-like metallic hollow bodies have facing end walls (21,22) which closely engage each other and have substantially the same contour in horizontal cross-section.

3. A combination according to claim 1 including a high-grade insulating material filling at least said second hollow body which is spaced away from said door body.

4. A combination according to claim 1 including a high-grade insulating material filling both of said hollow bodies.

5. A combination according to claim 1 or claim 2 or claim 3 or claim 4, including a holding section (4) connected to an inside surface of said door body facing said hollow bodies, said holding section extending inwardly of the chamber when said door body is in the chamber opening, and an inner channel extending through said first hollow body and another inner channel extending at least into the second body, each inner channel having substantially the same profile in vertical cross-section and being engaged over said holding section.

6. A combination according to claim 5 wherein said holding section extends substantially horizontally.

7. A combination according to claim 6 wherein said holding section extends at a slight upward inclination from the vertical in a direction away from said door body.

8. A combination according to claim 5 wherein said holding section is a substantially horizontally extending hollow section having a hollow cross-section taken in a vertical plane.

9. A combination according to claim 8 wherein said cross-section of said hollow section is substantially the same as the cross-sections of said inner channels, said inner channels being engaged over said hollow section.

10. A combination according to claim 9 wherein said cross-section of said hollow section is rectangular.

11. A combination according to claim 5 wherein at least one of said hollow bodies has a substantially trapezoidal cross-section taken in a horizontal plane, said trapezoidal cross-section having lateral sides defining said lateral walls which converge in a direction toward the other of said hollow bodies.

12. A combination according to claim 11 wherein both of said hollow bodies are at least partly trapezoidal in cross-section taken in a horizontal plane, both trapezoidal cross-section having lateral sides defining said lateral walls which converge toward the lateral wall of the other of said hollow bodies.

13. A combination according to claim 12 wherein said second hollow body which is spaced away from said door body includes a portion (*7b*) which is adjacent the first hollow body and which has a trapezoidal cross-section taken in a horizontal plane, and a portion (*7a*) which is spaced away from the first hollow body (6) which has a rectangular cross-section taken in a horizontal plane.

14. A combination according to claim 2 wherein said end face of one of said hollow bodies includes a cut-out which is rectangular in horizontal cross-section, said end face of the other hollow body having a shoulder which corresponds in horizontal cross-section to that of said cut-out, and into which said cut-out is engaged.

15. A combination according to claim 1 or 14, wherein said second hollow body (7) which is spaced away from said door body includes a vertical coal-contacting plate (16) on a wall thereof which is spaced furthest away from said door body, said wall including vertical slits (17) for receiving said coal-contacting plate, whereby said coal-contacting plate is readily replaceable.

* * * * *